US008146398B2

(12) United States Patent
Chiu et al.

(10) Patent No.: US 8,146,398 B2
(45) Date of Patent: Apr. 3, 2012

(54) CRUST BENDING APPARATUS

(75) Inventors: Kuo-chuan Chiu, Tu Cheng (TW); Yu-feng Lin, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 79 days.

(21) Appl. No.: 12/854,830

(22) Filed: Aug. 11, 2010

(65) Prior Publication Data

US 2012/0036912 A1 Feb. 16, 2012

(51) Int. Cl.
*B21D 5/04* (2006.01)

(52) U.S. Cl. ..... 72/323

(58) Field of Classification Search ..... 72/311, 72/312, 317, 319, 323
See application file for complete search history.

(56) References Cited

U.S. PATENT DOCUMENTS 5,341,666 A * 8/1994 Codatto ..... 72/323
6,170,315 B1 * 1/2001 Codatto ..... 72/316
6,189,360 B1 * 2/2001 Hatty ..... 72/308
6,196,041 B1 * 3/2001 Codatto ..... 72/323
6,227,028 B1 * 5/2001 Jeandeaud ..... 72/306
8,006,531 B2 * 8/2011 Patuzzi et al. ..... 72/306

* cited by examiner

*Primary Examiner* — Faye Francis
(74) *Attorney, Agent, or Firm* — Cheng-Ju Chang

(57) ABSTRACT

A crust bending apparatus includes a positioning assembling and a bending assembly. The positioning assembly includes a conveyance cylinder, a conveyance block, a positioning cylinder, a positioning rod, a positioning block, a holding cylinder, a holding rod, and a holding block. The bending assembly includes a bending cylinder, a bending rod, a bending block, first and second pivot pins, a line-to-rotation conversion member, and an outer casing. The bending rod has an end coupled to the bending cylinder and an opposite end forming a projection having a circular cross-section on a side surface thereof. The projection is received in a position constraint slot defined in the line-to-rotation conversion member. The apparatus is operated with power cylinder based mechanisms to replace human labor in bending a metal crust in order to reduce undesired influence of human factor and also to realize stable assembling operation and improve product passing rate and throughput.

7 Claims, 7 Drawing Sheets

CRUST BENDING APPARATUS

BACKGROUND OF THE INVENTION

1. Field of the Invention

The present invention generally relates to a machine, and in particular to a crust bending apparatus.

2. The Related Arts

An electrical connector plays a role of fast interfacing and is widely used in electronic products. Various electrical connectors comprise an insulation plastic housing that partly enclose conductive terminal pieces with the terminal pieces embedded therein for secured retention. Often, a portion of each of the terminal pieces that is not to be enclosed by the plastic of the housing is clamped by a mold and then molten plastic is filled into the mold. An integrated electrical connector can thus be formed after the molten plastic solidifies. An electrical connector of this kind comprises an insulation housing and a set of terminal pieces received and fixed in the housing. The terminal set may include signal terminals that are received in the insulation housing and at least one pair of switching terminals. The insulation housing of the electrical connector is often enclosed by a metal crust. The metal crush provides protection and structural reinforcement to the outside of the insulation housing. The metal crust often comprises a resilient holding portion, which provides a resilient abutment for securely holding an external plug, so that the plug can be securely coupled to the connector without undesired or unexpected separation.

Conventionally, the metal crust is applied to the insulation housing of an electrical connector with a jig. Due to the progress of technology, various miniaturized electrical connectors are available now. The application of the metal crust to the insulation housings of such miniaturized connectors is still carried out with human hands. A metal plate is first bent by hands and then the bent plate is set to enclose the insulation housing. Since the size of the housing of a miniaturized connector is tiny, bending and enclosing a metal crust around the housing is extremely difficult. This leads to an increase of the number of operation stations in an assembling line and also an additional period of time for the assembling. Further, the percentage of flaw products made in this way is also high and the operation efficiency is low. Thus, it is desired to have a crust bending apparatus that is operated with power cylinder based mechanisms to replace human labor in bending a metal crust in order to reduce undesired influence of human factor and also to realize stable assembling operation and improve product passing rate and throughput.

SUMMARY OF THE INVENTION

The present invention aims to overcome the above discussed drawbacks of the state-of-the-art technology by providing a crust bending apparatus that is operated with power cylinder based mechanisms to replace human labor in bending a metal crust in order to reduce undesired influence of human factor and also to realize stable assembling operation and improve product passing rate and throughput.

To achieve the above objective, the present invention provides a crust bending apparatus, which is applicable to bending a metal crust, which includes a fixed portion and a bent portion, for enclosing outside an electrical connector. The crust bending apparatus comprises a positioning assembly and a bending assembly. The positioning assembly comprises a conveyance cylinder, a conveyance block, a holding cylinder, a holding rod, a holding block, a positioning cylinder, a positioning rod, and a positioning block. The conveyance cylinder, the conveyance block, the holding cylinder, the holding rod, the holding block are arranged horizontally in such a way that the conveyance cylinder is coupled to a front end of the conveyance block; a rear end of the conveyance block is positioned against an end of the holding rod; and an opposite end of the holding rod is coupled to the holding cylinder. The positioning cylinder, the positioning rod, and the positioning block are arranged vertically in such a way that the positioning cylinder is coupled through the positioning rod to an upper end of the positioning block and a lower end of the positioning block is engageable with the rear end portion of the conveyance block. The bending assembly comprises a bending cylinder, a bending rod, a bending block, and a line-to-rotation conversion member. The bending block comprises coupling portions that are located on opposite sides and are substantially rectangular and a bending portion connected between the coupling portions. The bending portion has an underside forming a bending surface. The line-to-rotation conversion member is of a rectangular configuration and forms a position constraint slot. The bending rod has an end coupled to the bending cylinder and an opposite end forming a projection having a circular cross-section on a side surface of the end. The projection is received, in a rotatable and movable manner, in the position constraint slot.

As such, the crust bending apparatus according to the present invention is operated with power cylinder based mechanisms to replace human labor in bending a metal crust so as to reduce undesired influence of human factor and also to realize stable assembling operation and improve product passing rate and throughput.

BRIEF DESCRIPTION OF THE DRAWINGS

The present invention will be apparent to those skilled in the art by reading the following description of a preferred embodiment of the present invention, with reference to the attached drawings, in which.

DETAILED DESCRIPTION OF PREFERRED EMBODIMENT

Figure 1:
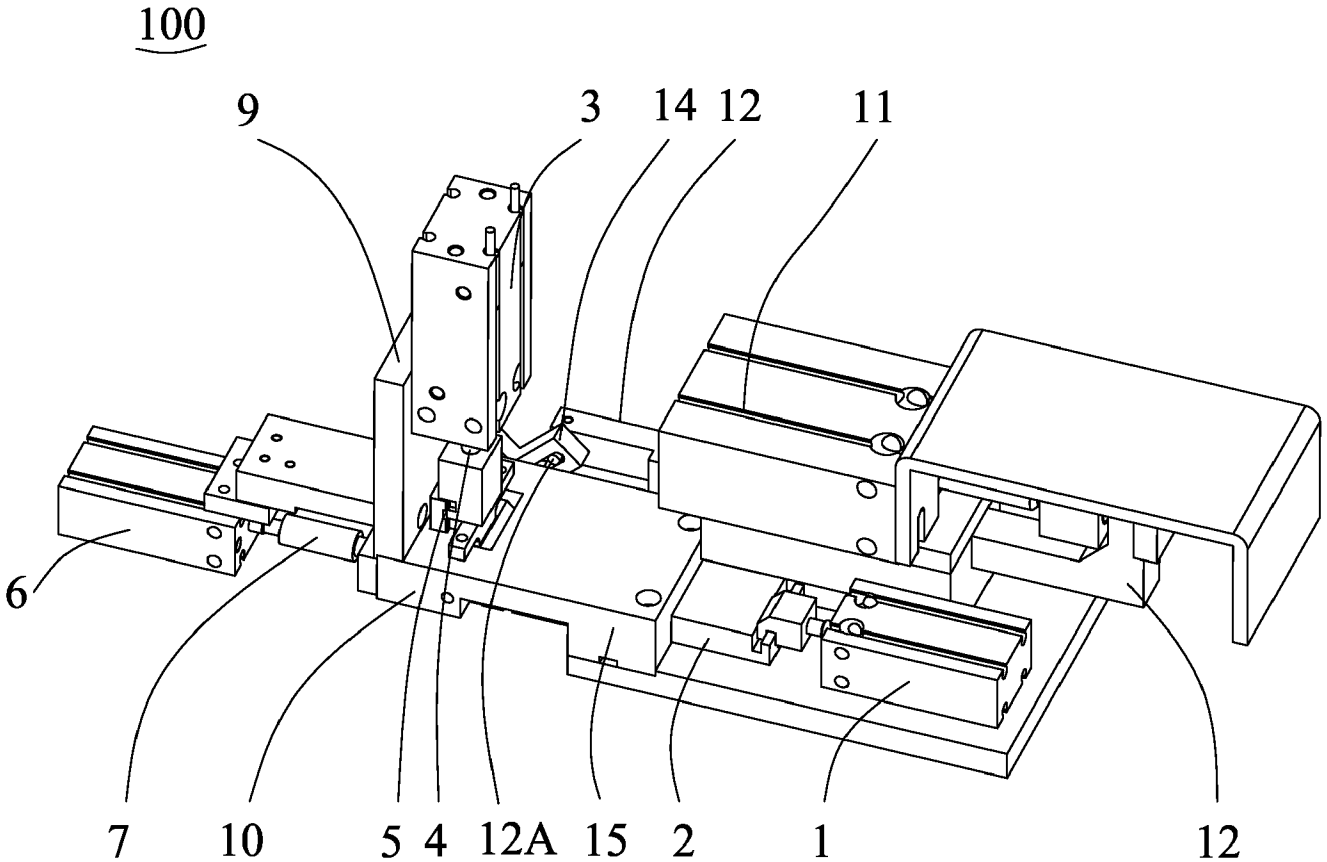
FIG. 1 is a perspective view showing a crust bending apparatus according to the present invention.
Figure 5:
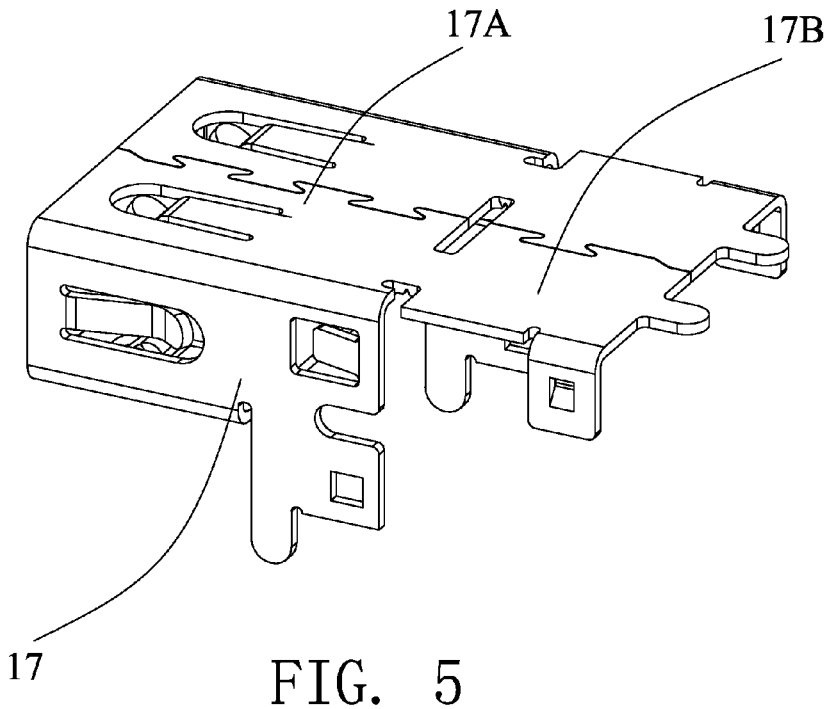
FIG. 5 is a perspective view of a crust to be bent with the crust bending apparatus of the present invention.
Figure 6:
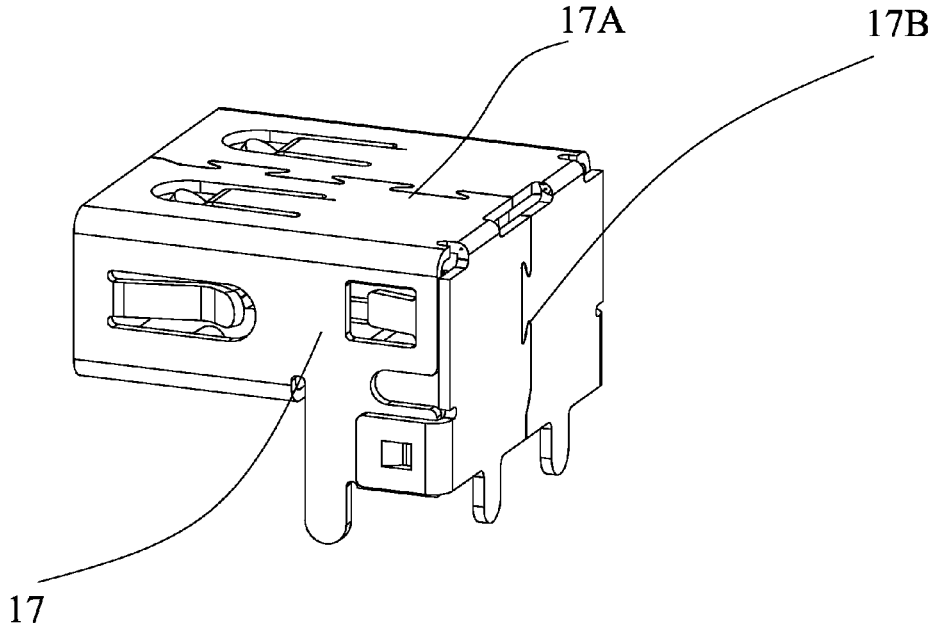
FIG. 6 is a perspective view showing the crust that is bent by the crust bending apparatus of the present invention.

With reference to the drawings and in particular to FIGS. 1, 5, and 6, the present invention provides a crust bending apparatus, generally designated at 100, which is used for bending a crust 17, preferably made of metal, surrounding outside an electrical connector. The crust 17 comprises a fixed portion 17*a* and a bent portion 17*b*.

Figure 2:
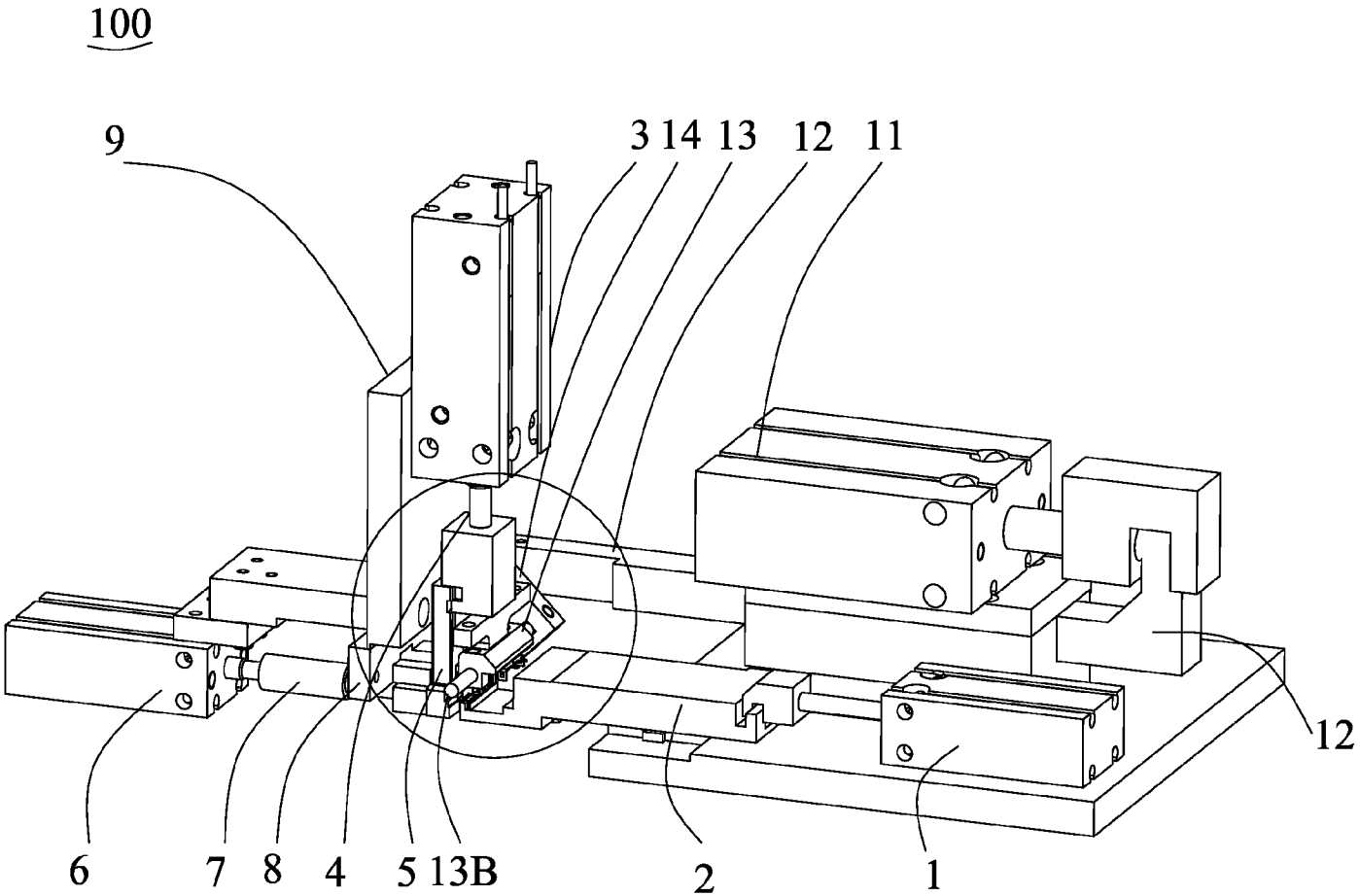
FIG. 2 is a perspective view illustrating the crush bending apparatus of the present invention is in operation for conveying a crush to be bent into a bending assembly of the crush bending apparatus for being ready for performance of bending operation.
Figure 3:
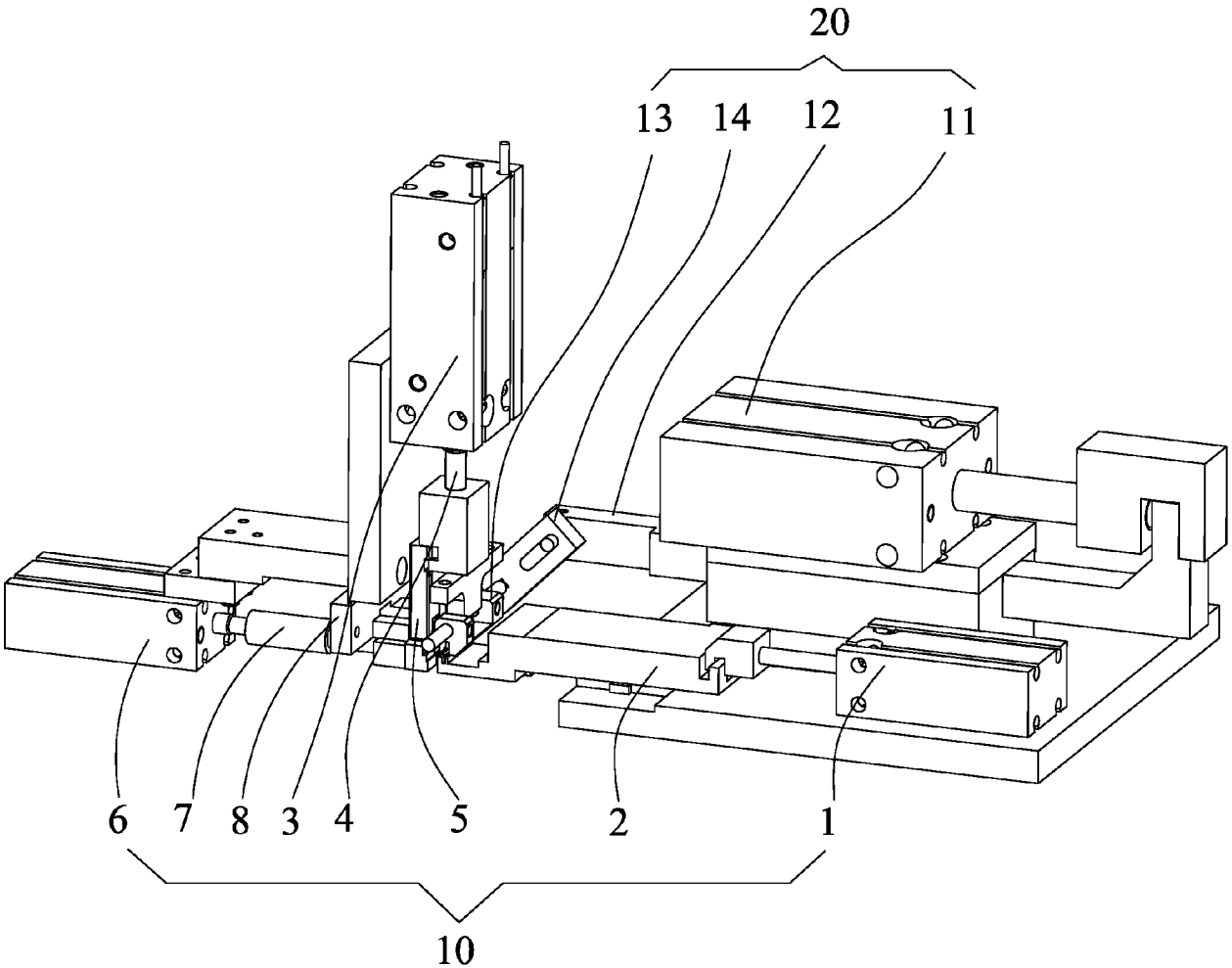
FIG. 3 is a perspective view illustrating the crust bending apparatus bends the crush with the bending assembly thereof.

Reference is made to FIGS. 2 and 3 for explanation of the crust bending apparatus 100 of the present invention. The crust bending apparatus 100 comprises a positioning assembly 10 and a bending assembly 20. The positioning assembly 10 comprises a conveyance cylinder 1, a conveyance block 2, a holding cylinder 6, a holding rod 7, a holding block 8, a positioning cylinder 3, a positioning rod 4, and a positioning block 5. The conveyance cylinder 1, the conveyance block 2, the holding cylinder 6, the holding rod 7, and the holding block 8 are arranged horizontally in such a way that the conveyance cylinder 1 is coupled to a front end of the conveyance block 2; a rear end of the conveyance block 2 is positioned against an end of the holding rod 7; and an opposite end of the holding rod 7 is coupled to the holding cylinder 6. The positioning cylinder 3, the positioning rod 4, and the positioning block 5 are arranged vertically in such a way that the positioning cylinder 3 is coupled through the positioning rod 4 to an upper end of the positioning block 5 and a lower end of the positioning block 5 is engageable with the rear end portion of the conveyance block 2. It is noted that the term "cylinder" used herein is referred to as a "power cylinder", unless specified otherwise.

Figure 8:
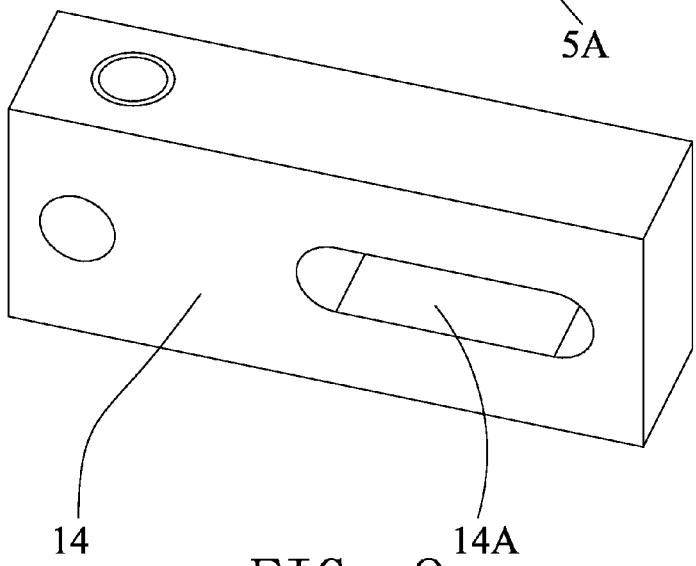
FIG. 8 is a perspective view of a line-to-rotation conversion member of the crust bending apparatus according to the present invention.
Figure 9:
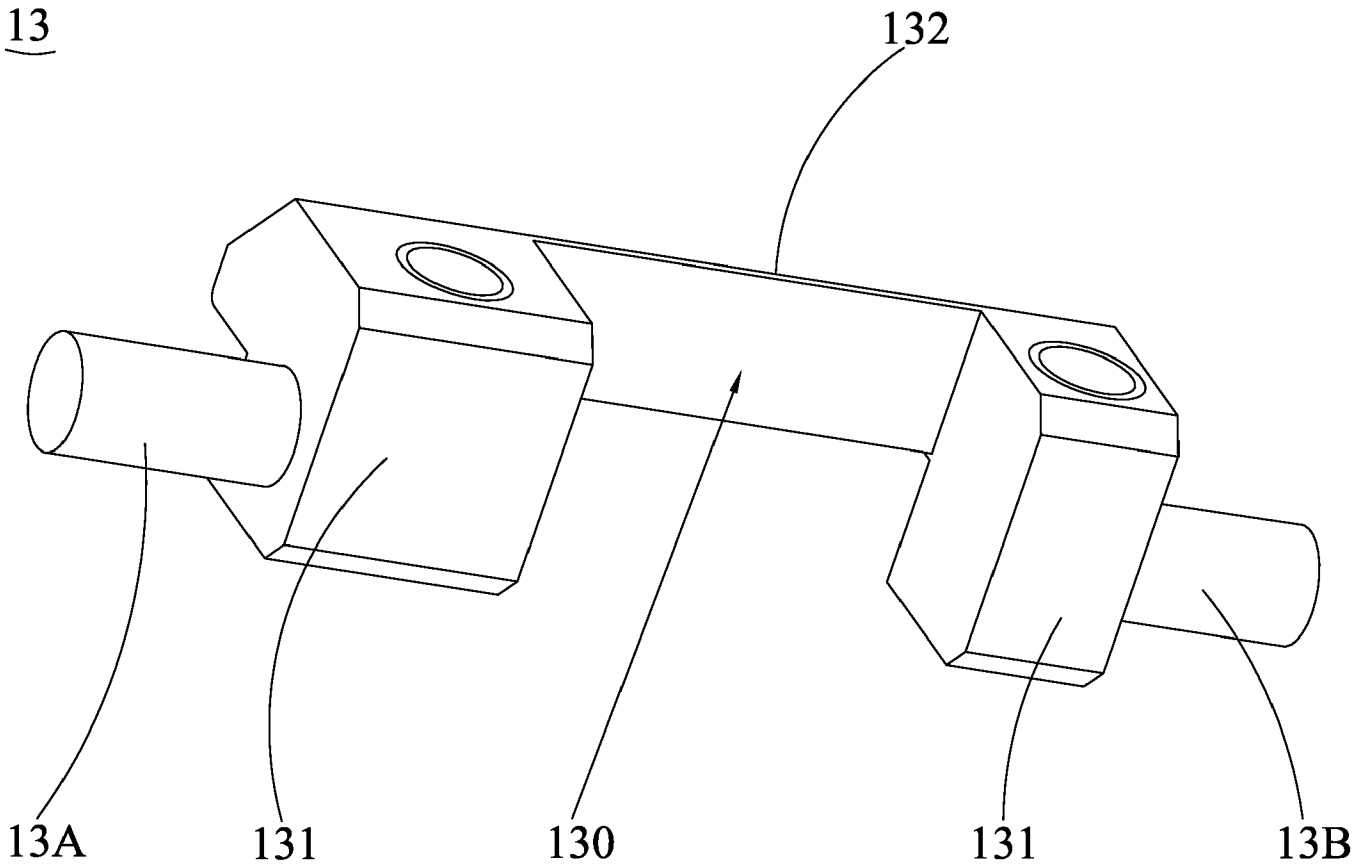
FIG. 9 is a perspective view of a bending block of the crust bending apparatus according to the present invention.

Referring to FIGS. 3, 8, and 9, the bending assembly 20 comprises a bending cylinder 11, a bending rod 12, a bending block 13, and a line-to-rotation conversion member 14. The bending block 13 comprises coupling portions 131 that are located on opposite sides and are substantially rectangular and a bending portion 132 connected between the coupling portions 131. The bending portion 132 has an underside forming a bending surface 130. The line-to-rotation conversion member 14 is of a rectangular configuration and forms a position constraint slot 14*a*.

Figure 4:
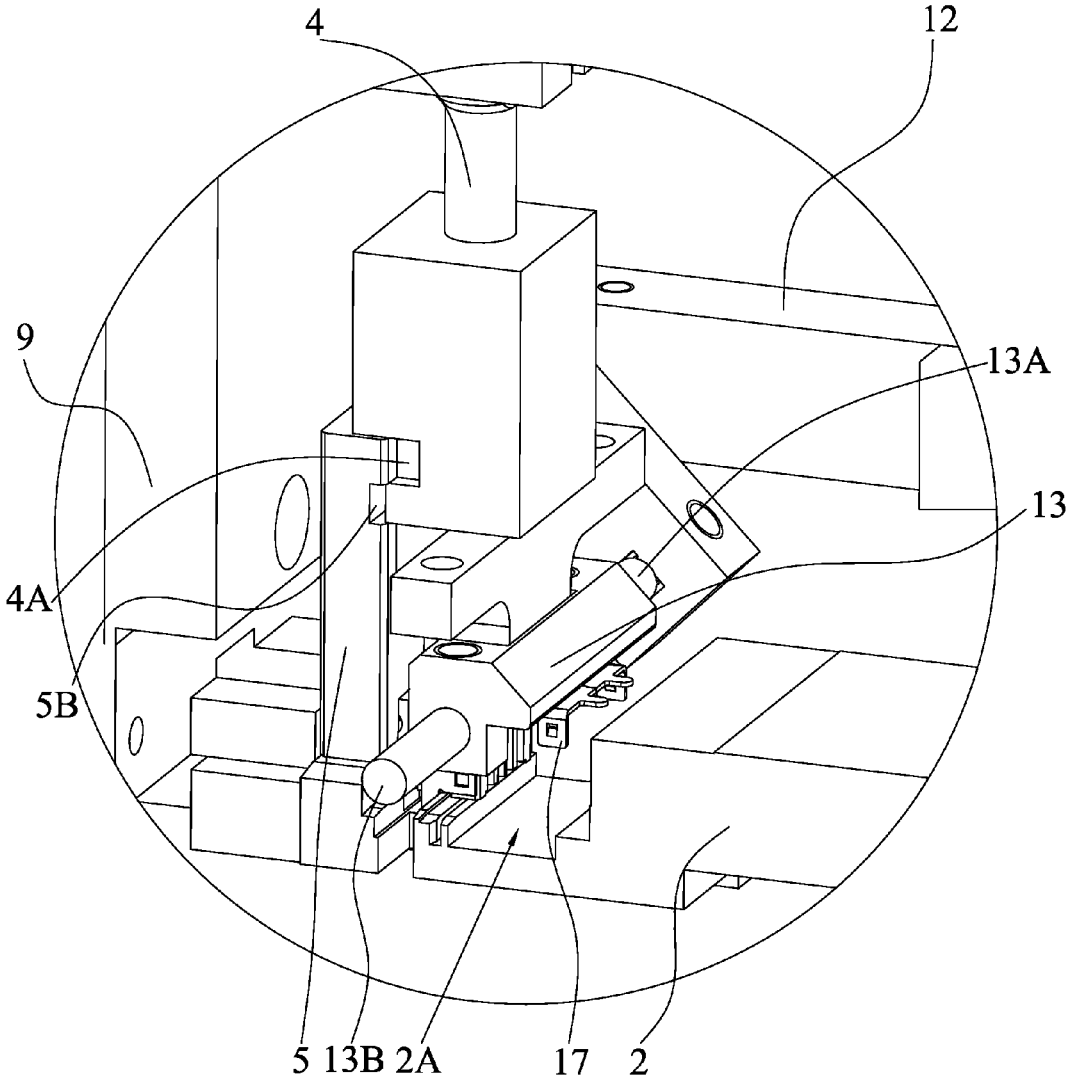
FIG. 4 is an enlarged view of a circled portion of FIG. 2.

Referring to FIGS. 1, 3, and 4, the bending rod 12 has an end coupled to the bending cylinder 11 and an opposite end forming a projection 12*a* having a circular cross-section on a side surface of the end. The projection 12*a* is received, in a rotatable manner, in the position constraint slot 14*a*. Specifically, an outer casing 15 is further included. The outer casing 15 is set on and encloses the bending block 13. Specifically, the coupling portions 131 are respectively fixed to a first pivot pin 13*a* and a second pivot pin 13*b*. The first pivot pin 13*a* and the second pivot pin 13*b* are arranged along the same axis and are parallel to the bending surface 130. The first pivot pin 13*a* is received in the line-to-rotation conversion member 14 and rotatably coupled to the line-to-rotation conversion member 14 and the second pivot pin 13*b* is pivotally coupled to the outer casing 15. As shown in FIG. 8, the position constraint slot 14*a* is an elongate slot having rounded end, which allows for better rotatable coupling with the projection 12*a* for movement and rotation of the projection 12*a* within the position constraint slot 14*a* to convert a linear motion into a rotary motion.

Referring to FIG. 4, the conveyance block 2 forms, at a location close to the rear end thereof, an accommodation chamber 2*a*, which is set below the bending block 13. The accommodation chamber 2*a* provides a free space for accommodating bending of the crust 17 so as to protect the bending portion from undesired impact and thus damage.

Figure 7:
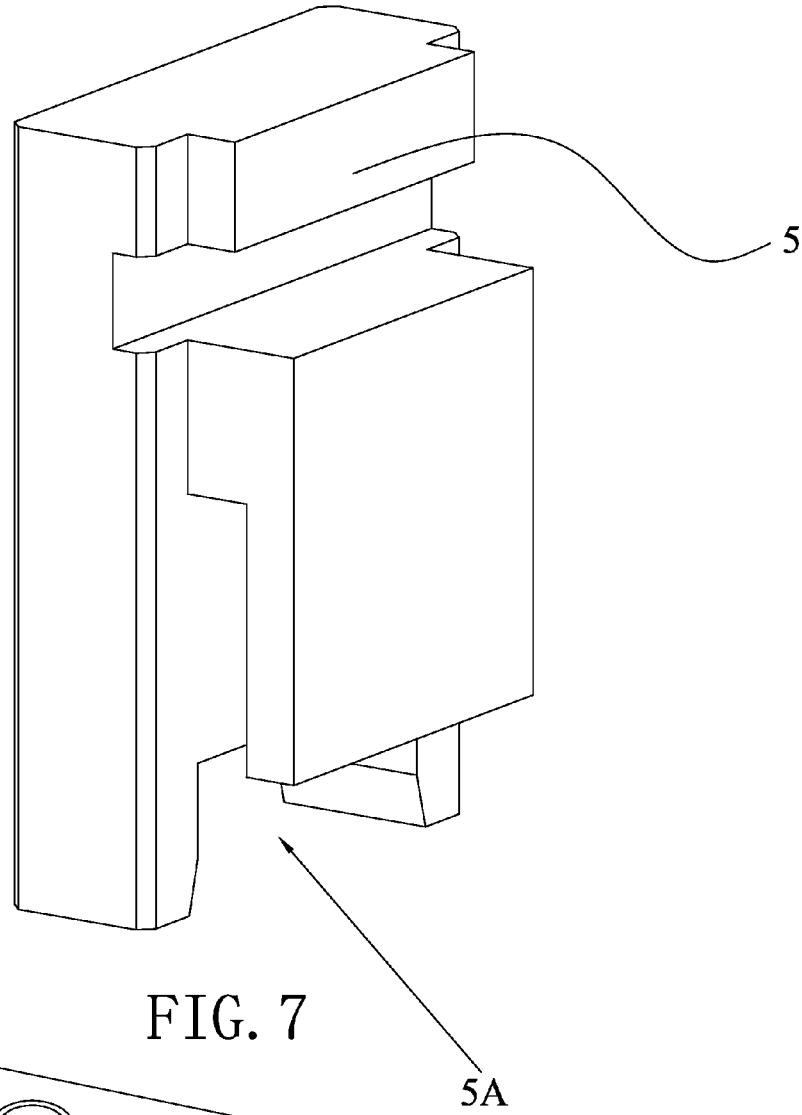
FIG. 7 is a perspective view showing a positioning block of the crust bending apparatus according to the present invention.

Referring FIGS. 3, 7, and 9, the positioning block 5 forms a retention slot 5*a* (FIG. 7), which has a vertical high point at the same level as the bending surface 130. Such an arrangement is for the purpose that when a crust 17 is moved into the bending block 13, the fixed portion 17*a* of the crust 17 is located and retained in the retention slot 5*a* and the bent portion 17*b* is located under the bending surface 130. Since the fixed portion 17*a* and the bent portion 17*b* of a crust 17 are on the same horizontal plane before a bending operation is performed on the crust, the bending surface 130 and the retention slot 5*a* having the high points at the same vertical level offers protection to the crust 17 in the course of bending and allows for precise performance of the bending operation on the crust 17.

Referring to FIGS. 2 and 4, a support member 9 is further provided. The support member 9 is coupled to the positioning block 5. The arrangement of the support member 9 is to provide support to the positioning block 5 and for better positioning of the crust 17.

To assemble the crust bending apparatus 100 of the present invention, the outer casing 15 is set around the bending block 13, which comprises the coupling portions 131 located on opposite sides and having rectangular cross-sections and a bending portion 132 connecting between the coupling portions 131 and having an underside forming the bending surface 130. The coupling portions 131 are respectively coupled to the first pivot pin 13*a* and the second pivot pin 13*b*. The first pivot pin 13*a* and the second pivot pin 13*b* are arranged along the same axis and are parallel to the bending surface 130. The line-to-rotation conversion member 14 is of a rectangular configuration and forms a position constraint slot 14*a*. The first pivot pin 13*a* is received in the line-to-rotation conversion member 14 and rotatably coupled to the line-to-rotation conversion member 14 and the second pivot pin 13*b* is pivotally coupled to the outer casing 15. The bending rod 12 has an end coupled to the bending cylinder 11 and an opposite end forming the projection 12*a* having a circular cross-section on a side surface of the end. The projection 12*a* is received, in a rotatable manner, in the position constraint slot 14*a*.

Referring to FIGS. 2 and 3, in the operation of the present invention, the crust 17 is positioned on the conveyance block 2, and the conveyance cylinder 1 drives the crust 17 positioned on the conveyance block 2 into the bending block 13. The positioning cylinder 3 then drives the positioning block 5 to press down. The holding cylinder 6 drives the holding block 8 against the rear end of the conveyance block 2. The bending cylinder 11 drives the bending rod 12 to cause rotation of the line-to-rotation conversion member 14. As such, the bending block 13 is caused to rotate by the line-to-rotation conversion member 14 so as to carry out a bending operation on the bent portion 17*b* of the crust 17, while the fixed portion 17*a* is located and retained in the retention slot 5*a*. The bent portion 17*b* is located under and positioned against the bending surface 130 and the fixed portion 17*a* and the bent portion 17*b* are located on the same horizontal plane before bending is carried out. The projection 12*a* of circular cross-section is rotatably received in the position constraint slot 14*a*, so that when the bending cylinder 11 moves the bending rod 12, the projection 12*a* is put into movement within the position constraint slot 14*a*. The position constraint slot 14*a* is arranged to provide the bending block 13 of a rotation range of maximum 90 degrees in both clockwise and counterclockwise directions for performing a desired bending operation on the crust 17.

In summary, the crust bending apparatus according to the present invention is operated with power cylinder based mechanisms to replace human labor in bending a metal crust so as to reduce undesired influence of human factor and also to realize stable assembling operation and improve product passing rate and throughput.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A crust bending apparatus, which is adapted to bend a crust for enclosing an electrical connector, comprising:

a positioning assembly, which comprises a conveyance cylinder, a conveyance block, a holding cylinder, a holding rod, a holding block, a positioning cylinder, a positioning rod, and a positioning block, wherein the conveyance cylinder, the conveyance block, the holding cylinder, the holding rod, the holding block are arranged horizontally in such a way that the conveyance cylinder is coupled to a front end of the conveyance block, a rear end of the conveyance block being positioned against an end of the holding rod, an opposite end of the holding rod being coupled to the holding cylinder, and wherein the positioning cylinder, the positioning rod, and the positioning block are arranged vertically in such a way that the positioning cylinder is coupled through the positioning rod to an upper end of the positioning block and a lower end of the positioning block is engageable with the rear end portion of the conveyance block; and a bending assembly, which is set adjacent to the positioning assembly so that the crush is conveyed by the positioning assembly to a predetermined position in the bending assembly for performing a bending operation, the bending assembly comprising a bending cylinder, a bending rod, a bending block, and a line-to-rotation conversion member, the bending block comprising coupling portions that are located on opposite sides and are substantially rectangular and a bending portion connected between the coupling portions, the bending portion having an underside forming a bending surface, the line-to-rotation conversion member being of a rectangular configuration and forming a position constraint slot, the bending rod having an end coupled to the bending cylinder and an opposite end forming a projection having a circular cross-section on a side surface of the end and received, in a rotatable and movable manner, in the position constraint slot.

2. The crust bending apparatus as claimed in claim 1, wherein the conveyance block forms, at a location close to the rear end thereof, an accommodation chamber, which is set below the bending block.

3. The crust bending apparatus as claimed in claim 1 further comprising an outer casing, the outer casing, which is set on and encloses the bending block.

4. The crust bending apparatus as claimed in claim 3, wherein the bending assembly a first pivot pin and a second pivot pin, the coupling portions being respectively fixed to the first pivot pin and the second pivot pin, the first pivot pin and the second pivot pin being arranged along the same axis and substantially parallel to the bending surface, the first pivot pin being received in the line-to-rotation conversion member and rotatably coupled to the line-to-rotation conversion member, the second pivot pin being pivotally coupled to the outer casing.

5. The crust bending apparatus as claimed in claim 1, wherein the positioning block forms a retention slot, which has a vertical high point at the same level as a high point of the bending surface.

6. The crust bending apparatus as claimed in claim 1, wherein the position constraint slot is an elongate slot having rounded ends.

7. The crust bending apparatus as claimed in claim 1 further comprising a support member, which is coupled to the positioning block.

* * * * *